US010094057B2

(12) United States Patent
Scortegagna

(10) Patent No.: US 10,094,057 B2
(45) Date of Patent: Oct. 9, 2018

(54) COMPACTING MACHINE FOR FABRICS AND CORRESPONDING COMPACTING METHOD

(71) Applicant: LAFER SPA, Schio (VI) (IT)

(72) Inventor: Bruno Scortegagna, Schio (IT)

(73) Assignee: LAFER SPA, Schio (VI) (IT)

( * ) Notice: Subject to any disclaimer, the term of this patent is extended or adjusted under 35 U.S.C. 154(b) by 0 days.

(21) Appl. No.: 15/788,295

(22) Filed: Oct. 19, 2017

(65) Prior Publication Data

US 2018/0038028 A1 Feb. 8, 2018

Related U.S. Application Data

(63) Continuation of application No. PCT/IT2016/000031, filed on Feb. 8, 2016.

(51) Int. Cl.
*D06C 21/00* (2006.01)

(52) U.S. Cl.
CPC ..... *D06C 21/00* (2013.01)

(58) Field of Classification Search
CPC ..... D06C 21/00; D06C 21/005; D06C 15/02; D06C 15/04; D06C 15/06; D06C 7/00; D06C 15/00; D06C 27/00
USPC ..... 26/18.5, 18.6
See application file for complete search history.

(56) References Cited

U.S. PATENT DOCUMENTS 1,864,373 A * 6/1932 Robertson ..... D06C 7/02 26/52
2,263,712 A * 11/1941 Wrigley ..... D06C 21/00 26/18.6
3,015,146 A * 1/1962 Cohn ..... D06C 5/00 26/18.6
3,226,796 A * 1/1966 Fox ..... D03D 15/08 139/423
3,471,907 A * 10/1969 Beckers ..... B31F 1/18 26/18.6
3,655,474 A 4/1972 Constantine
3,694,870 A * 10/1972 Fischer ..... D06C 21/00 26/18.6
4,888,860 A 12/1989 Metzen
4,969,243 A * 11/1990 Strahm ..... D06C 5/00 26/18.6
5,016,329 A 5/1991 Milligan
6,173,507 B1 * 1/2001 Catallo ..... D06C 21/00 26/18.5
8,590,122 B2 * 11/2013 West ..... D06C 21/00 26/18.6

(Continued)

FOREIGN PATENT DOCUMENTS

EP 1357217 10/2003
GB 2148342 5/1985

OTHER PUBLICATIONS

International Search Report filed in PCT/IT2016/000031 dated Nov. 2, 2016.

*Primary Examiner* — Amy Vanatta
(74) *Attorney, Agent, or Firm* — Rankin, Hill & Clark LLP

(57) ABSTRACT

A compacting machine for compacting a fabric includes at least a first compacting module suitable to carry out a mechanical-type compacting treatment, and at least a second compacting module, suitable to carry out a felt-type compacting treatment. The second compacting module is disposed in direct connection and directly downstream of the first compacting module in a direction of feed of the fabric.

8 Claims, 2 Drawing Sheets

(56) References Cited

U.S. PATENT DOCUMENTS

2016/0375539 A1* 12/2016 Kubala ..... B24B 7/12
451/415

* cited by examiner

COMPACTING MACHINE FOR FABRICS AND CORRESPONDING COMPACTING METHOD

FIELD OF THE INVENTION

The present invention concerns a compacting machine for fabrics, usable to confer on the fabrics a desired dimensional stability before they are sent for making up. The invention also concerns the corresponding compacting method.

BACKGROUND OF THE INVENTION

In the field of textile finishing it is known to subject a fabric to compacting, which serves mainly to stabilize the fabric in its dimensions, preventing subsequent shrinkage and/or unexpected variations in size.

In order to carry out such treatment, some different types of compacting machines are known in the state of the art, which are normally chosen according to the quality of the fabric to be treated, and also the final quality required, the desired productivity, and partly also the type of market for which the fabric is intended.

In particular, compacting machines for knitwear fabrics are substantially divided into two categories, i.e. compacting machines of the felt type and compacting machines of the mechanical type.

The former are generally used to obtain high-quality fabrics, generally intended for markets that require fabrics are soft to the touch, and are therefore used by producers that mainly focus on the quality of the fabrics obtained, often to the detriment of the speed of production.

The latter, on the contrary, are used by producers of fabrics who are required to treat large quantities of fabrics, to the detriment of the quality, mainly in terms of the feel that is conferred on them.

It is known that compacting machines of the felt type comprise, as their main elements, a heated cylinder around which the fabric to be compacted is wound, and a felt strip that rotates outside the fabric and presses the fabric against the surface of the cylinder. The fabric to be compacted is guided to the entrance, between the cylinder and the felt strip, by an introduction element generally called "lead-in".

The presence of the felt-type compacting element allows to confer on the fabric a high-quality soft feel.

One disadvantage of felt-type compacting machines is that they allow to reach only low work speeds, in the range of 25-35 m/min, and are therefore not very efficient in terms of productivity.

Mechanical compacting machines generally comprise, as their main elements, an introduction cylinder and a rubber-coated cylinder, generally defined "retarding cylinder", which rotates at a lower speed than the introduction cylinder. The fabric is guided to the entrance between the two cylinders by a shaped blade element.

The compacting of the fabric is determined by the combined effect of the blade shaped element that guides the fabric between the introduction cylinder and the rubber-coated cylinder, and the rubber-coated cylinder that "slows down" the fabric and therefore compacts it in the direction of feed.

Mechanical compacting machines allow to reach much higher working speeds than those of the felt type, up to 60-80 m/min, and allow to obtain high values of compacting, but they confer on the fabric a poor quality feel, to that the fabric is stiff and not soft.

Another disadvantage of mechanical compacting machines is that they do not guarantee high dimensional stability of the fabrics, since only a part of the compacting applied is stabilized and remains over time.

For these reasons, in the state of the art, mechanical compacting machines are mainly used when it is necessary to process large quantities of fabrics, generally average to low quality, in a short time, while felt-type compacting machines are used when fabrics are to be processed that require a high-quality feel.

There is therefore a well-established custom among operators in this field to consider the two treatment methods, and the corresponding types of machine, as intended for different markets, for example high-range and average/small productions for felt-type compacting machines and low-range and high productions for mechanical compacting machines.

Therefore, based on the requests from the makers-up, the market sectors, the garments to be obtained, the productivity required, the price margins obtainable and the technical competence of the operators, a specific choice is made by those operating in the field, who identify and select from the different types of compacting machines the one that best satisfies the requests received.

The purpose of the invention is to overcome the limits of current methods and machines, and to provide a compacting machine with high flexibility and the ability to satisfy requirements considered conflicting and incompatible until now, in an efficient, versatile and compact solution that can be configured according to needs.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a compacting machine for fabrics according to the present invention comprises at least a first compacting module suitable to carry out a mechanical compacting treatment, and at least a second compacting module, disposed in direct connection and directly downstream of the first compacting module, suitable to carry out a felt-type compacting treatment.

In other words, somewhat surprisingly, and overcoming established and consolidated convictions for a long time widespread among those operating in the field, Applicant has found that, subjecting the fabric to be worked first to a mechanical compacting pass and then, in direct spatial and temporal continuity, to a second compacting pass using the known technology with a felt, it is possible to combine the advantages deriving from the high productivity of mechanical treatment with those deriving from the high quality of the felt treatment.

By suitably regulating the reciprocal operating parameters of the two modules, a high percentage of the compacting to be obtained can therefore be attributed to the first mechanical compacting pass, with a treatment speed high enough to guarantee sufficient productivity.

The remaining and residual portion of compacting to be carried out is then attributed to the second compacting pass using a felt which, precisely because of the residual portion of compacting to be obtained, can perform its operation at a speed compatible with the first mechanical pass, thus guaranteeing that production requirements are satisfied. However, thanks to its intrinsic characteristics, the pass with the felt guarantees that the fabric exiting from the second compacting module will have a high surface quality and feel, with characteristic softness typical of the felt treatment.

The felt-type compacting treatment therefore allows to eliminate the stiff and board-like effect of the fabric, typical of mechanical compacting, supplying the characteristic soft feel, typical of compacting with a felt.

Furthermore, the heated cylinder of the felt-type compacting module performs a stabilization and/or heat-setting of the degree of compacting obtained with the mechanical compacting module, preventing part of the shrinkage of the fabric from disappearing, which leads to a greater overall compacting effect.

In one formulation of the invention, the compacting machine comprises at least a load cell disposed between the first mechanical compacting module and the second felt-type compacting module, configured to regulate the tension of the fabric based on its speed of advance in the first mechanical compacting module and the felt-type compacting module.

According to a variant, the compacting machine according to the present invention also comprises a plurality of return cylinders, configured to allow to bypass one or more modules depending on the type of compacting to be applied to the fabric.

According to another variant, inside its overall bulk, the compacting machine comprises a re-boring cylinder, configured to allow to re-bore the rubber-coated cylinder of the mechanical compacting module, without having to disassemble it.

This allows to reduce the number of maintenance interventions, and also the length of the downtimes needed for re-boring and hence the overall running costs.

Embodiments described here also concern a method for compacting a fabric which provides to carry out a first rough compacting pass of the mechanical type on the fabric and a second finishing compacting pass of the felt type, made in direct continuity both spatial and temporal with respect to the first rough compacting of the mechanical type.

According to some embodiments, the first rough compacting pass of the mechanical type corresponds to about 70-85% of the amount of overall compacting to be applied to the fabric, while the second finishing compacting pass of the felt type can correspond to about 15-30% of the amount of overall compacting.

By amount of overall compacting, here and hereafter in the description, we mean the overall amount of shrinking in a longitudinal direction conferred on a fabric by a compacting machine, i.e. the overall difference in length of the fabric measured before and after the compacting treatment.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
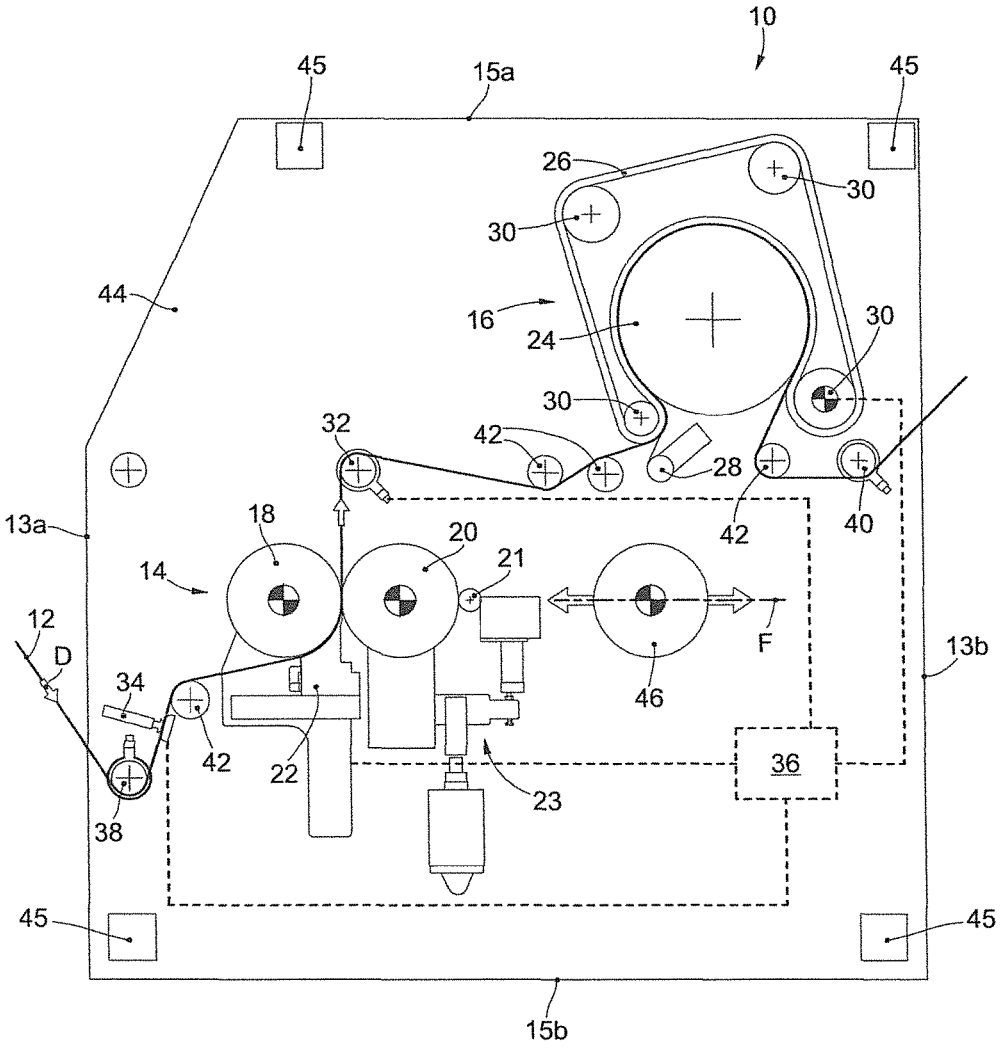
FIG. 1 is a schematic view of a compacting machine according to some embodiments described here in a first operating configuration.

We shall now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

According to the present description, embodiments described here concern a compacting machine 10 of the hybrid type, configured to work fabrics 12 which, merely by way of non-restrictive example of the present invention, can be natural fabrics of wool or cotton, or synthetic fabrics of cotton-Lycra, 100% Lycra, viscose or suchlike.

The fabric 12 is preferably an open fabric, but it is not excluded that it can also be a tubular fabric 12, or folded over on itself lengthwise and sewn, providing suitable modifications and adaptations of the compacting machine 10.

The compacting machine 10 comprises at least one first mechanical compacting module 14 and at least one second felt-type compacting module 16.

The at least one second felt-type compacting module 16 is located downstream and in direct connection, both temporal and spatial, with the at least one first mechanical compacting module 14.

It is understood that the term "at least" refers to the fact that there can be two or more first mechanical compacting modules and two or more second felt-type compacting modules, but the felt-type compacting modules are always downstream of the last mechanical compacting module.

In particular, the at least one first mechanical compacting module 14 is disposed in correspondence with an entrance side 13*a* of the compacting machine 10 and the at least one second felt-type compacting module 16 is located in correspondence with an exit side 13*b* of the compacting machine 10 in a direction of feed D of the fabric 12.

The first mechanical compacting module 14 is configured to perform the bigger share of the overall amount of compacting to be applied to the fabric 12. Therefore, the second felt-type compacting module 16 is responsible for a small, residual share of the overall compacting and in particular, advantageously if not limited to, the share needed to confer the desired soft feel to the fabric 12.

Since it only has to carry out a minimum and residual part of the compacting, the second felt-type compacting module 16 can work at higher speeds than those generally used in state-of-the-art compacting machines that work only with a felt; according to the present invention, for example, the compacting machine 10 can obtain working speeds of up to 50-60 m/min.

With the configuration according to the present invention, it is therefore possible to obtain a fabric 12 with a soft feel comparable to that of a compacting machine working only with a felt, at the same time working at speeds that approach those of a mechanical compacting machine.

According to some embodiments, the first mechanical compacting module 14 comprises an introduction cylinder 18, also called feed cylinder, a rubber-coated cylinder 20, also called retarding cylinder, and a shaped blade 22 to introduce the fabric between the two cylinders 18, 20.

According to some embodiments, an introduction element or lead-in element can be associated with the shaped blade 22, to facilitate the introduction of the fabric 12 between the introduction cylinder 18 and the rubber-coated cylinder 20 and/or to protect the shaped blade 22 from wear.

According to some embodiments, the introduction cylinder 18 is covered with gripping material to facilitate gripping of the fabric 12 that winds around it, while the rubber-coated cylinder 20 is covered with rubber or similar material, so as to brake the fabric 12 and compact it, thanks to the difference in speed between the two cylinders 18 and 20.

According to possible solutions, the rubber-coated cylinder 20 rotates at a speed lower than that of the introduction cylinder 18, for example at half the speed of rotation of the introduction cylinder 18.

According to some embodiments, the introduction cylinder 18 can be heated, so as to partly heat the fabric 12 winding on it in order to make the compacting action more effective.

The rubber-coated cylinder 20 may generally not be heated. To prevent drops of condensation from forming on the external surface of the rubber-coated cylinder 20, which could cause defects if they came into contact with the fabric 12, the first mechanical compacting module 14 can comprise a drying cylinder 21.

According to some solutions, the drying cylinder 21 is covered with permeable material and is located adjacent to and in contact with the rubber-coated cylinder 20 so as to absorb any drops of condensation on the surface of the latter.

According to some embodiments, the first mechanical compacting module 14 also comprises a positioning device 23, configured to regulate and adjust the position of the rubber-coated cylinder 20, for example to regulate its distance from the feed cylinder 18 as a function of the thickness of the fabric 12.

According to some embodiments, the second felt-type compacting module 16 can comprise a heated cylinder 24, around which the fabric 12 to be compacted winds, a felt strip 26 that presses the fabric against the heated cylinder 24, and an introduction or lead-in element 28.

According to some embodiments, the felt strip 26 is wound around a plurality of return rolls 30, at least one of which is motorized to command the motion of the felt strip 26.

According to some embodiments, the compacting machine 10 can comprise at least one load cell 32, disposed between the first mechanical compacting module 14 and the second felt-type compacting module 16 and configured to regulate the tension of the fabric 12 between exit from the first mechanical compacting module 14 and entrance into the second felt-type compacting module 16.

According to some embodiments, the compacting machine 10 can comprise a device to measure thickness 34, configured to measure the thickness of the fabric 12 to be compacted.

According to possible solutions, the device to measure thickness 34 can be disposed in correspondence with the entrance side 13*a*, for example upstream of the first mechanical compacting module 14.

According to some embodiments, the compacting machine 10 can also comprise a control and command unit 36, connected at least to the first mechanical compacting module 14 and to the second felt-type compacting module 16 and configured to regulate the respective work speeds thereof, for example as a function of the type of fabric 12 and the type of compacting required.

The control and command unit 36 can be connected for example to drive members (not shown) of the introduction cylinder 18, the rubber-coated cylinder 20 and at least one return cylinder 30 of the felt strip 26, so as to regulate their respective speeds of rotation as a function of the fabric 12 to be processed.

The control and command unit 36 can also be connected to the load cell 32, so as to regulate the functioning at least of the second felt-type compacting module 16 as a function of the tension of the fabric 12 exiting from the mechanical compacting module 14.

According to some embodiments, the control and command unit 36 can also be connected to the possible device to measure thickness 34, so as to regulate the functioning of the first mechanical compacting module 14 and the second felt-type compacting module 16 as a function of the thickness of the fabric 12.

According to some embodiments, the compacting machine 10 can comprise an entrance load cell 38, positioned upstream of the first mechanical compacting module 14 and configured to regulate the tension of the fabric 12 entering.

According to possible solutions, the compacting machine 10 can comprise an exit load cell 40, positioned downstream of the second felt-type compacting module 16 and configured to regulate the tension of the fabric 12 exiting.

According to some embodiments, the compacting machine 10 can comprise return rolls 42 located downstream and/or upstream of the first mechanical compacting module 14 and/or the second felt-type compacting module 16 to set a desired path for the fabric 12 and to keep it correctly tensed.

According to embodiments described using FIGS. 1-4, the compacting machine 10 comprises at least a lateral structure 44, defined by the entrance side 13*a*, the exit side 13*b* and the respective upper 15*a* and lower 15*b* sides, on which at least a first mechanical compacting module 14 and at least a second felt-type compacting module 16 are simultaneously installable.

According to some embodiments, the compacting machine 10 comprises two lateral structures 44 facing each other and having facing walls equipped specularly for the installation of the at least one first mechanical compacting module 14 and the at least one second felt-type compacting module 16.

According to some embodiments, the lateral structures 44 can be joined together and held in position by suitable elements, called beams or tie-rods 45.

According to possible solutions, the first mechanical compacting module 14 and the second felt-type compacting module 16 are disposed with the respective insertion and exit sides of the fabric 12 facing toward the central part of the lateral structures 44. In this way the operations to insert the fabric 12 are facilitated.

The drawings show, by way of example, an embodiment in which the first mechanical compacting module 14 is positioned in the lower part of the lateral structure 44, while the second felt-type compacting module 16 is positioned in the upper part. Naturally, variants can be provided in which the first mechanical compacting module 14 can be positioned in the upper part of the lateral structure 44, while the second felt-type compacting module 16 can be positioned in the lower part. The alternate disposition of the modules 14, 16 in the lower and upper part of the upright 44 allows to reduce the bulk and to obtain a compacting machine 10 that is both compact and versatile.

In other variants, it can also be provided that the two modules 14, 16 are aligned with each other in any direction: horizontal, vertical or inclined.

According to some embodiments, the compacting machine 10 can comprise, inside its overall bulk, a re-boring cylinder 46, configured to allow to re-bore the rubber-coated cylinder 20 of the first mechanical compacting module 14, without needing to disassemble it. In fact, since it is made of rubber material, the rubber-coated cylinder 20 can get worn, for example due to friction with the fabric 12, or if it comes into contact with the introduction cylinder 18 covered with gripping material.

The re-boring cylinder 46 allows to reduce both the number of maintenance interventions and also the duration of the machine downtimes needed for re-boring, and hence the overall running costs.

According to some embodiments, the re-boring cylinder 46 is configured to be able to translate in a direction F toward/away from the rubber-coated cylinder 20. The rubber-coated cylinder 20 can also be moved near to the re-boring cylinder 46 for the re-boring operation by the positioning device 23.

Embodiments described here with reference to FIG. 1 also concern a method for compacting a fabric 12.

The compacting method provides to carry out a first rough compacting of the mechanical type on the fabric 12 in a first mechanical compacting module 14 and a second finishing compacting of the felt type on the fabric 12 in a second felt-type compacting module 16, carried out in direct connection both spatial and temporal with respect to the first mechanical compacting.

In particular, the second felt-type finishing compacting is carried out immediately downstream and in continuity with the first rough compacting of the mechanical type.

According to the configuration in FIG. 1, the fabric 12 can be fed to the compacting machine 10 in direction D, made to transit between the introduction cylinder 18 and the rubber-coated cylinder 20 guided by the shaped blade 22, to be subjected to a first rough compacting of the mechanical type, then it is wound around the load cell 32 and finally made to pass, guided by the introduction element 28, between the felt strip 26 and the heated cylinder 24, to be subjected to a second finishing compacting of the felt type.

In this case, for example, the first rough compacting of the mechanical type can correspond to about 70-85% of the amount of overall compacting to be applied to the fabric 12, while the second finishing compacting of the felt type can correspond to about 15-30% of the amount of overall compacting.

Furthermore, the passage of the fabric 12, already partly compacted in the first mechanical compacting module 14, around the heated cylinder 24 of the second felt-type compacting module 16, allows to stabilize and heat set the compacting made on the fabric 12, preventing part of the first rough compacting from disappearing.

According to some embodiments, the distance between the exit of the fabric from the first mechanical compacting module 14 and the heated cylinder 24 is minimal, sufficient to guarantee that the fabric 12 arrives in correspondence with the heated cylinder 24 before part of the compacting made on the fabric 12 disappears.

This allows to obtain a better and more effective compacting, and hence a greater dimensional stability of the fabric 12.

Figure 2:
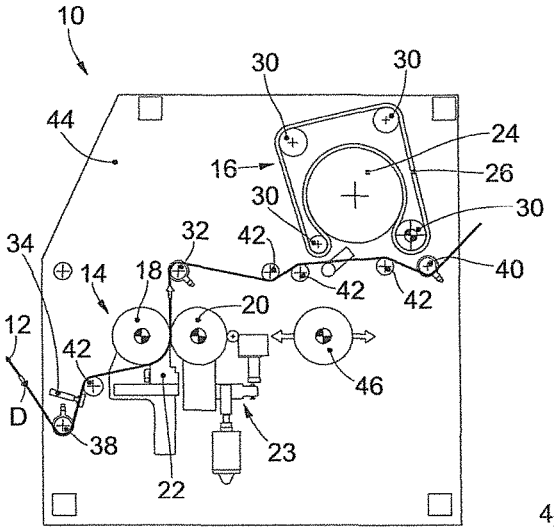
FIG. 2 is a schematic view of a compacting machine according to some embodiments described here in a second operating configuration.
Figure 3:
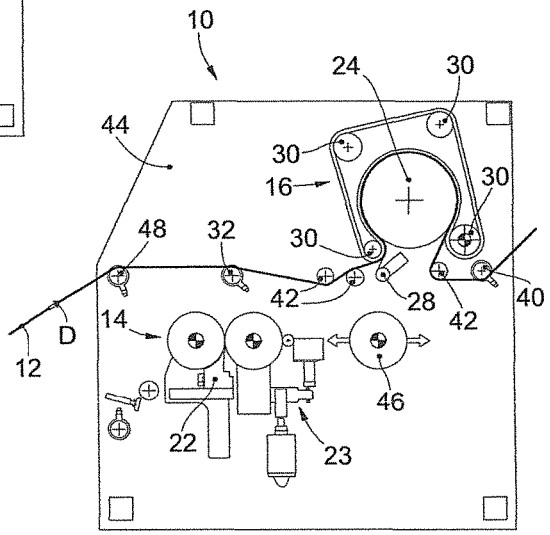
FIG. 3 is a schematic view of a compacting machine according to some embodiments described here in a third operating configuration.
Figure 4:
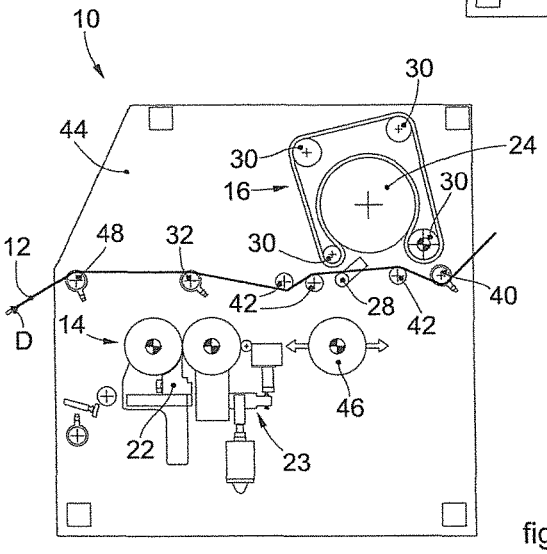
FIG. 4 is a schematic view of a compacting machine according to some embodiments described here in a fourth operating configuration.

According to embodiments described using FIGS. 2-4, the compacting machine 10 can also be used for different treatments of the fabric 12. For example, it is also possible to perform on a fabric 12 only a mechanical compacting (FIG. 2), only a felt-type compacting (FIG. 3), or no compacting (FIG. 4).

According to the configuration in FIG. 2, for example if large quantities of fabrics that do not require a particular feel are to be processed, the fabric 12 can be fed in direction D in the first mechanical compacting module 14, and can then wind around the load cell 32, the return rolls 42 and the exit load cell 40, bypassing the second felt-type compacting module 16.

In this way, only a mechanical compacting is carried out on the fabric 12, and higher speeds can be reached than those of the configuration in FIG. 1.

According to the configuration in FIG. 3, the fabric 12 can be fed in direction D, so as to bypass the first mechanical compacting module 14 and transit between the felt strip 26 and the heated cylinder 24 guided by the introduction element 28, so as to be subjected to a felt-type compacting only. In this case, another entrance load cell 48 can be provided, disposed upstream of the load cell 32, to regulate the tension of the fabric 12 entering the compacting machine 10. In this way, only a felt-type compacting is carried out on the fabric 12, similar to what can be obtained with a traditional compacting machine.

The compacting machine 10 is therefore very versatile and allows to carry out different types of processes on a fabric 12 simply by modifying the path of the fabric 12 in the modules 14, 16.

Furthermore, according to the configuration in FIG. 4, the compacting machine 10 allows to bypass both modules, for example if the machine is positioned downstream of a tentering machine or raiser and the fabric 12 processed does not need compacting. In this case too, the other entrance load cell 48 can be provided. According to this configuration, the fabric 12 winds around the entrance load cell 48, the load cell 32, through the return rolls 42 and around the exit load cell 40.

The versatility offered by the possible different configurations allows to install the compacting machine 10 in any fabric finishing line whatsoever, without having to dedicate specific lines for compacting of one type or the other, so that on each occasion it is possible to choose the optimum configuration to use.

It is clear that modifications and/or additions of parts may be made to the compacting machine 10 as described heretofore, without departing from the field and scope of the present invention.

For example, according to possible embodiments, downstream of the second felt-type compacting module 16, one or more other felt-type compacting modules can be provided, configured to work on the same side of the fabric 12 as the second felt-type compacting module 16, or on the opposite side.

It is also clear that, although the present invention has been described with reference to some specific examples, a person of skill in the art shall certainly be able to achieve many other equivalent forms of hybrid compacting machine, having the characteristics as set forth in the claims and hence all coming within the field of protection defined thereby.

The invention claimed is:

1. A compacting machine for compacting a fabric, comprising at least one first compacting module for carrying out a mechanical compacting treatment, and at least one second compacting module, disposed in direct connection and immediately downstream of said first compacting module in a direction of feed of the fabric for carrying out a felt compacting treatment, wherein said first compacting module comprises an introduction cylinder, a rubber-coated retarding cylinder spaced from the introduction cylinder so as to receive the fabric between the introduction cylinder and the retarding cylinder with the fabric in contact with each cylinder, and a shaped blade to introduce the fabric between the introduction cylinder and the retarding cylinder, and said second compacting module comprises a heated cylinder, around which the fabric to be compacted winds, a felt strip that presses the fabric against the heated cylinder, and an introduction element suitable to introduce the fabric between the surface of the heated cylinder and said felt strip.

2. The compacting machine as in claim 1, further comprising an entrance side and an exit side defined by said direction of feed of said fabric, and said at least one first compacting module is disposed nearer to said entrance side, and said at least one second compacting module is located nearer to said exit side.

3. The compacting machine as in claim 1, further comprising at least one load cell disposed between said first compacting module and said second compacting module and configured to regulate tension of the fabric between exit from said first compacting module and entrance into said second compacting module.

4. The compacting machine as in claim 3, further comprising a control and command unit, connected at least to said first compacting module and to said second compacting module and configured to regulate respective work speeds thereof as a function of the type of fabric and/or the type of compacting required.

5. The compacting machine as in claim 4, wherein said control and command unit is connected to said load cell, so as to regulate functioning at least of said second compacting module as a function of the tension of the fabric exiting from said first compacting module.

6. The compacting machine as in claim 1, further comprising a re-boring cylinder, configured to re-bore the retarding cylinder of the first compacting module, without needing to disassemble the retarding cylinder.

7. A method for compacting a fabric, comprising:

carrying out a first mechanical compacting on said fabric in which said fabric is in contact with an introduction cylinder and a rubber-coated retarding cylinder;

carrying out a second finishing compacting on said fabric with felt, said second finishing compacting being carried out immediately downstream and in direct continuity both spatial and temporal to said first mechanical compacting.

8. The method as in claim 7, wherein said first compacting corresponds to about 70-85% of an amount of overall compacting to be applied to the fabric and said second finishing compacting corresponds to about 15-30% of said amount of overall compacting.

* * * * *